US011649802B2

(12) United States Patent
Hosokawa

(10) Patent No.: US 11,649,802 B2
(45) Date of Patent: May 16, 2023

(54) SLIDING MEMBER

(71) Applicant: DAIDO METAL COMPANY LTD., Aichi (JP)

(72) Inventor: Junpei Hosokawa, Inuyama (JP)

(73) Assignee: DAIDO METAL COMPANY LTD., Aichi (JP)

( * ) Notice: Subject to any disclaimer, the term of this patent is extended or adjusted under 35 U.S.C. 154(b) by 0 days.

(21) Appl. No.: 17/690,670

(22) Filed: Mar. 9, 2022

(65) Prior Publication Data

US 2022/0307461 A1 Sep. 29, 2022

(30) Foreign Application Priority Data

Mar. 25, 2021 (JP) ..... JP2021-051691

(51) Int. Cl.

| | |
|---|---|
| ***F03C 1/06*** | (2006.01) |
| ***F04B 1/2078*** | (2020.01) |
| ***F04B 53/14*** | (2006.01) |
| ***F03C 1/28*** | (2006.01) |
| ***F04B 1/2064*** | (2020.01) |
| ***F04B 1/126*** | (2020.01) |

(52) U.S. Cl.

CPC ..... *F03C 1/0668* (2013.01); *F03C 1/0605* (2013.01); *F04B 1/126* (2013.01); *F04B 1/2064* (2013.01); *F04B 1/2078* (2013.01); *F04B 53/14* (2013.01)

(58) Field of Classification Search

CPC ..... F03C 1/0605; F03C 1/0668; F04B 1/126; F04B 1/2078; F04B 53/14

USPC ..... 92/71, 155

See application file for complete search history.

(56) References Cited

U.S. PATENT DOCUMENTS

| | | | | |
|---|---|---|---|---|
| 4,683,804 | A * | 8/1987 | Futamura | F04B 27/0886 417/269 |
| 6,860,255 | B2 * | 3/2005 | Yamaguchi | F04B 1/0413 123/495 |
| 6,877,418 | B2 * | 4/2005 | Ishizaki | F04B 1/126 29/898.041 |
| 6,926,779 | B1 * | 8/2005 | Bin | B32B 15/017 148/435 |
| 7,004,061 | B2 * | 2/2006 | Kurihara | F04B 27/109 92/71 |
| 7,255,933 | B2 * | 8/2007 | Sato | F04B 27/1054 419/33 |
| 7,513,758 | B2 * | 4/2009 | Kirkland | F16L 5/02 417/532 |
| 10,792,733 | B2 * | 10/2020 | Mueller | B22F 7/04 |

FOREIGN PATENT DOCUMENTS

JP 2020016150 A 1/2020

* cited by examiner

*Primary Examiner* — Michael Leslie
(74) *Attorney, Agent, or Firm* — Karceski IP Law, PLLC

(57) ABSTRACT

A sliding member including, a support layer and a sliding layer provided on a side of one end surface of the support layer configured to slide on a mating member, the sliding layer having a hardness set higher toward an outer side than at a center in an axial direction.

4 Claims, 13 Drawing Sheets

| NUMBER OF RECIPROCATING CYCLES | | SLIDING DIRECTION | STATIC FRICTION COEFFICIENT $\mu s$ | DYNAMIC FRICTION COEFFICIENT $\mu k$ |
|---|---|---|---|---|
| EXAMPLE | 1 | CENTER → OUTER | 0.183 | 0.155 |
| | | OUTER → CENTER | 0.174 | 0.165 |
| | 100 | CENTER → OUTER | 0.253 | 0.177 |
| | | OUTER → CENTER | 0.238 | 0.196 |
| COMPARATIVE EXAMPLE | 1 | CENTER → OUTER | 0.290 | 0.287 |
| | | OUTER → CENTER | 0.268 | 0.250 |
| | 100 | CENTER → OUTER | 0.363 | 0.350 |
| | | OUTER → CENTER | 0.430 | 0.360 |

FIG. 8

| | SLIDING POSITION | NUMBER OF SLIDES | STATIC FRICTION COEFFICIENT $\mu s$ | DYNAMIC FRICTION COEFFICIENT $\mu k$ |
|---|---|---|---|---|
| EXAMPLE | CENTER | 1 | 0.192 | 0.164 |
| | | 1000 | 0.296 | 0.256 |
| | OUTER | 1 | 0.170 | 0.147 |
| | | 1000 | 0.289 | 0.203 |
| COMPARATIVE EXAMPLE | CENTER | 1 | 0.174 | 0.144 |
| | | 1000 | 0.655 | 0.650 |
| | OUTER | 1 | 0.194 | 0.175 |
| | | 1000 | 0.686 | 0.633 |

FIG. 9

| LUBRICATING OIL | | OIL RETENTION CAPACITY (%) | IMPROVEMENT RATE (%) |
|---|---|---|---|
| VG-22 | EXAMPLE | 0.01977 | 384 |
| | COMPARATIVE EXAMPLE | 0.00515 | 100 |
| VG-68 | EXAMPLE | 0.02997 | 553 |
| | COMPARATIVE EXAMPLE | 0.00541 | 100 |

FIG. 11

SLIDING MEMBER

CROSS REFERENCE TO RELATED APPLICATIONS

This application claims the benefit of priority to Japanese Patent Application Number 2021-051691 filed on Mar. 25, 2021. The entire contents of the above-identified application are hereby incorporated by reference.

FIELD OF THE INVENTION

This embodiment relates to a sliding member, and, in particular, relates to a sliding member used in a piston of a piston pump.

BACKGROUND OF THE INVENTION

A swash plate piston pump is widely used as a hydraulic pump or a hydraulic motor. A swash plate piston pump includes a swash plate and a piston, and the piston is reciprocally driven in an axial direction by the swash plate that rotates (JP 2020-16150 A).

In this configuration, an end portion of the piston on the swash plate side slides on the rotating swash plate. That is, the piston slides on the swash plate by coming into contact with the rotating swash plate at the end portion of the piston on the swash plate side. Therefore, the piston includes a sliding member at the end portion on the swash plate side. This sliding member slides on the rotating swash plate as described above and is subjected to force in the axial direction of the piston from the swash plate and a fluid pressurized by the piston. Therefore, there is a problem in that the sliding member is prone to biased wear in a radial direction about the axis of the piston.

SUMMARY OF THE INVENTION

Hence, an object of the present disclosure is to provide a sliding member with reduced biased wear and further improved wear resistance by setting an appropriate hardness according to the site.

To solve the problems described above, a sliding member of this embodiment includes a support layer and a sliding layer provided on a side of one end surface of the support layer configured to slide on a mating member, the sliding layer having a hardness set higher toward an outer side than at a center in an axial direction.

The sliding layer has a hardness set higher toward the outer side than toward a center side with an axis thereof as the center. That is, the sliding layer has a gradient in hardness in a radial direction, and the outer side is harder than the center side. Therefore, when sliding on a swash plate, for example, the sliding layer has improved wear resistance on a hard outer peripheral side even when subjected to force from the center side to the outer side due to rotation of the swash plate. Further, even when a large force is applied from a fluid to be compressed on the center side, for example, the force is received by a soft portion at the center, the force is transmitted to the outer side, and the shape is maintained by a hard portion on the outer side. That is, the structure of the sliding layer of this embodiment is similar to a configuration in which hard sword steel is interposed between soft irons which are relatively soft to increase overall strength, such as in a Japanese sword. As a result, even under severe conditions such as even higher pressure, for example, biased wear is reduced by appropriate hardness according to the site. Accordingly, overall wear resistance can be further improved.

Further, in the sliding member of this embodiment, the sliding layer is porous with a plurality of pores, and a porosity of the sliding layer is from 0.1% to 3.2%.

When the porosity thus increases, an amount of lubricating oil retained in an interior of the sliding layer increases. That is, the lubricating oil is retained in the pores formed in the sliding layer. Therefore, by increasing the porosity, friction between the sliding layer and the mating member can be reduced. Accordingly, the wear resistance can be further improved.

BRIEF DESCRIPTION OF DRAWINGS

FIG. 8 is a table schematically showing a relationship between sliding direction, static friction coefficient, and dynamic friction coefficient of the example and the comparative example.

FIG. 9 is a table schematically showing a relationship between sliding position, number of slides, static friction coefficient, and dynamic friction coefficient of the example and the comparative example.

FIG. 11 is a table schematically showing a relationship between lubricating oil and oil retention capacity of the example and the comparative example.

DESCRIPTION OF EMBODIMENTS OF THE INVENTION

Hereinafter, embodiments will be described in detail with reference to the drawings.

Figure 1:
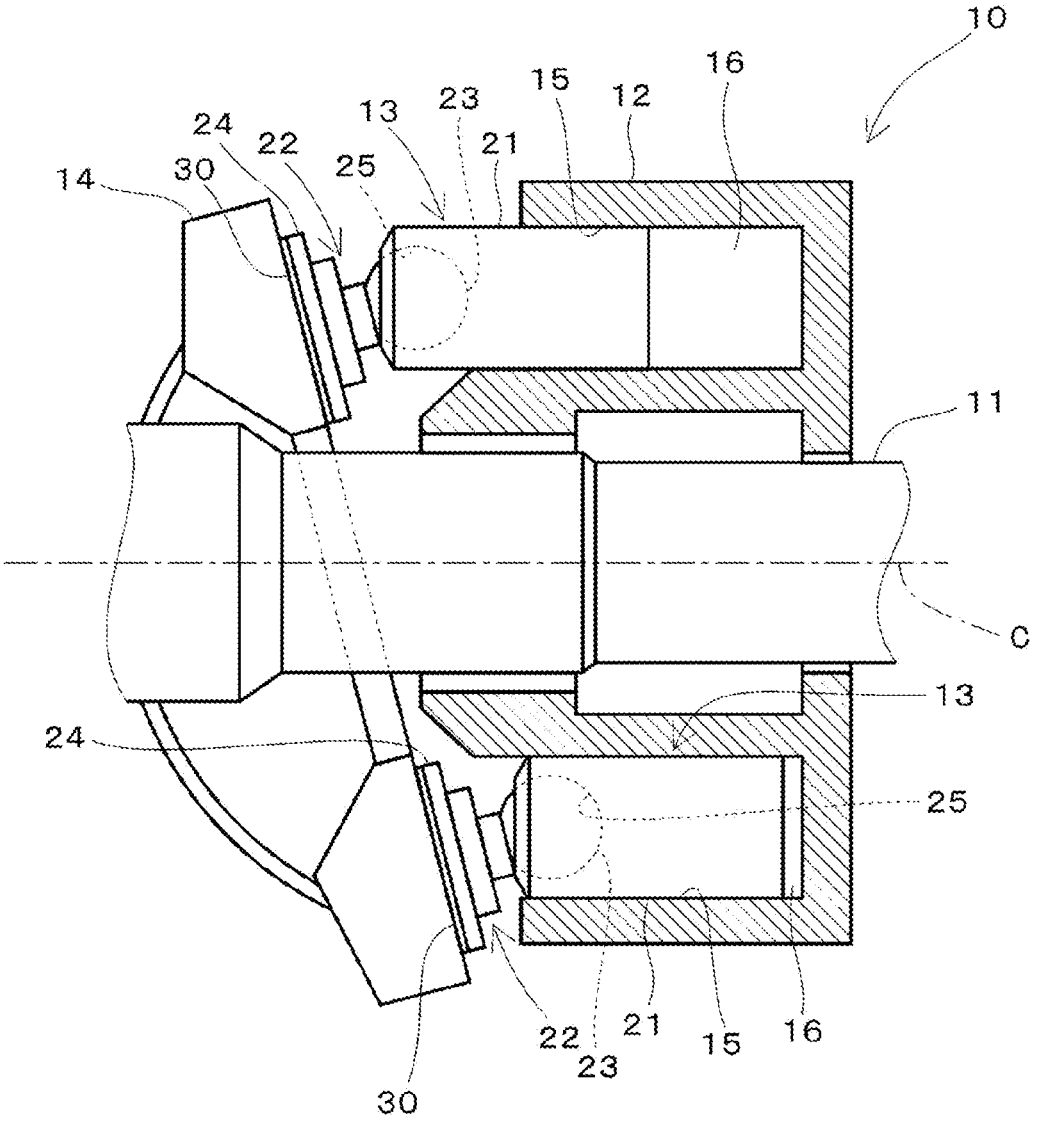
FIG. 1 is a schematic cross-sectional view illustrating a piston pump to which a sliding member according to an embodiment is applied.

FIG. 1 illustrates a piston pump 10 to which a sliding member according to an embodiment is applied. The piston pump 10 includes a rotating shaft member 11, a cylinder block 12, a piston 13, and a swash plate 14. Note that while the piston pump 10 is described in this embodiment, this embodiment is also applicable as a piston motor by inversion of a hydraulic circuit. The swash plate 14 is attached to the rotating shaft member 11. The rotating shaft member 11 is supported by a bearing member (not illustrated) and rotates together with the swash plate 14. The cylinder block 12 forms a plurality of cylinders 15. Specifically, the cylinder block 12 includes a plurality of cylinders 15 in a circumferential direction about the rotating shaft member 11. The piston 13 is provided in each of the cylinders 15 formed by the cylinder block 12. An outer diameter of the piston 13 is formed slightly smaller than an inner diameter of the cylinder 15. As a result, the piston 13 reciprocates in an axial direction inside the cylinder 15 while sliding on an inner wall of the cylinder block 12 forming the cylinders 15. The cylinder block 12 and the piston 13 form a fluid chamber 16 at an end portion on a side opposite to the swash plate 14 in the axial direction.

Figure 2:
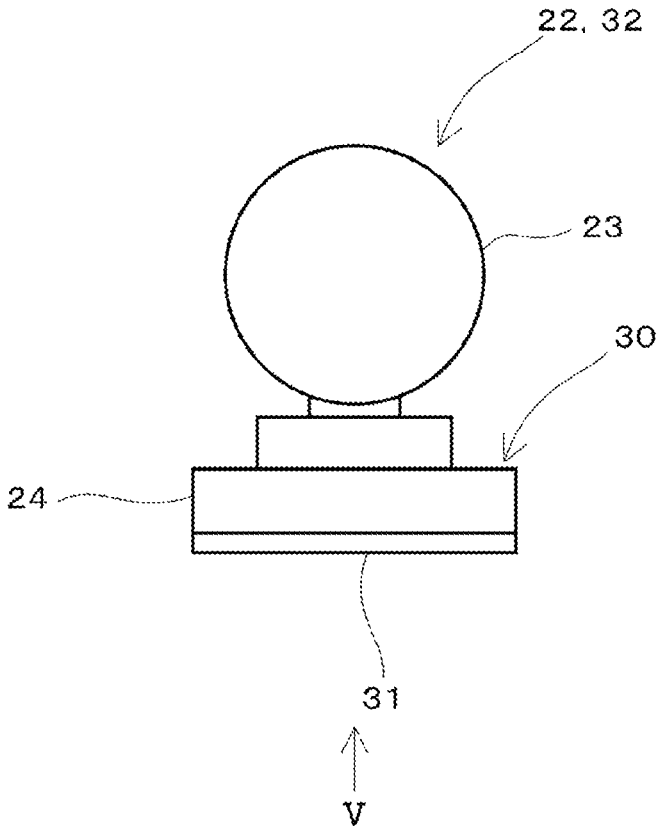
FIG. 2 is a schematic front view illustrating a piston shoe of the piston pump to which the sliding member according to an embodiment is applied.

The piston 13 includes a piston body 21 and a piston shoe 22. The piston body 21 and the piston shoe 22 are integrally movable in the axial direction. The piston shoe 22 includes a head portion 23 and a base portion 24 as illustrated in FIG. 2. The head portion 23 is formed into a spherical shape. As illustrated in FIG. 1, the piston body 21 includes, at an end portion on the piston shoe 22 side, an inner wall 25 having a spherical shape. The head portion 23 of the piston shoe 22 is fitted into the end portion of the piston body 21. An outer diameter of the head portion 23 is formed slightly smaller than an inner diameter of the inner wall 25. Therefore, the head portion 23 and the inner wall 25 of the piston body 21 are permitted to move in a three-dimensional direction. Thus, the piston body 21 and the piston shoe 22 can be connected in an articulated manner and assume a posture at a free angle within a predetermined range.

The swash plate 14 is inclined with respect to a center axis C of the rotating shaft member 11. That is, the center axis C of the rotating shaft member 11 and the swash plate 14 form a predetermined angle without intersecting at a right angle. The piston 13 is in contact with the swash plate 14 at an end portion in the axial direction, that is, an end portion on a side opposite to the fluid chamber 16. The swash plate 14 inclined with respect to the center axis C rotates with the rotating shaft member 11, driving the plurality of pistons 13 in contact with the swash plate 14 in an axial direction of the rotating shaft member 11 while the plurality of pistons 13 slides on the swash plate 14 in a circumferential direction of the rotating shaft member 11. As a result, the piston 13 reciprocates in the axial direction inside the cylinder 15 due to force received from the fluid in the fluid chamber 16 and force received in the axial direction of the center axis C by the rotation of the swash plate 14. Because the piston body 21 and the piston shoe 22 are connected in an articulated manner, the piston 13 moves inside the cylinder 15 with a stable posture.

When the piston 13 moves toward the fluid chamber 16 by the rotation of the inclined swash plate 14, the fluid in the fluid chamber 16 is pressurized. The pressurized fluid is discharged from a discharge passage (not illustrated) formed in the cylinder block 12. On the other hand, when the piston 13 moves toward the swash plate 14, fluid is suctioned into the fluid chamber 16 via a suction passage (not illustrated). The piston 13 reciprocates inside the cylinder 15 by the rotation of the swash plate 14, causing the suction of the fluid into the fluid chamber 16 and the pressurization of the fluid to be repeated.

Note that while the piston pump 10 is described in this embodiment, the piston pump 10 having such a configuration is also applicable as a piston motor by inversion of the hydraulic circuit. That is, a rotational force of the rotating shaft member 11 is obtained by introducing the pressurized fluid into the fluid chamber 16 in the reverse order of the embodiment described above. As a result, this embodiment is also applicable as a piston motor that uses the pressure of fluid to obtain a rotational force. As the fluid, a liquid such as water or oil, a gas, or a supercritical fluid can be freely used.

A sliding member 30 of this embodiment is provided at an end portion of the piston 13. Specifically, as illustrated in FIG. 2, the sliding member 30 is provided at an end portion of the piston shoe 22 on the swash plate 14 side. The sliding member 30 includes a sliding layer 31 and a support layer 32. In this embodiment, the support layer 32 corresponds to the piston shoe 22. The sliding layer 31 is provided on an end surface side of the piston shoe 22, which is the support layer thereof, that is, on an end portion of the base portion 24 positioned on a side opposite to the head portion 23. The sliding layer 31 is formed of a Cu-based alloy containing Cu as a main component. The sliding layer 31 may contain Sn, Zn, Ni, Pb, Bi, Fe, or the like as an added element with Cu as the main component. The sliding member 30 slides on the swash plate 14 by the rotation of the swash plate 14.

In the case of this embodiment, the sliding layer 31 has a circular shape in a cross section perpendicular to an axis thereof in accordance with a shape of an end of the base portion 24 of the piston shoe 22. Note that the shape of the cross section of the sliding layer 31 perpendicular to the axis can be set as desired in accordance with the shape of the base portion 24. The hardness of the sliding layer 31 is different at a center and an outer side in the axial direction. More specifically, the sliding layer 31 has a hardness set higher toward an outer side, that is, an outer peripheral side, than at the center in the axial direction. In other words, the sliding layer 31 is set to be increasingly relatively softer toward the center in the axial direction and increasingly relatively harder toward the outer peripheral side.

The sliding layer 31 is porous and includes a plurality of pores in an interior thereof. That is, the sliding layer 31 is not formed of a uniform alloy in its entirety, but rather is formed with a large number of pores. In the case of this embodiment, the sliding layer 31 has a porosity set to from 0.1% to 3.2% in volume. The porosity of the sliding layer 31 is preferably from 0.6% to 2.6%, and more preferably from 1.2% to 2.0%.

Manufacturing Method of Sliding Member

Next, a manufacturing method of the sliding member 30 according to an embodiment will be described.

The sliding member 30 is manufactured by using sintering.

Figure 3:
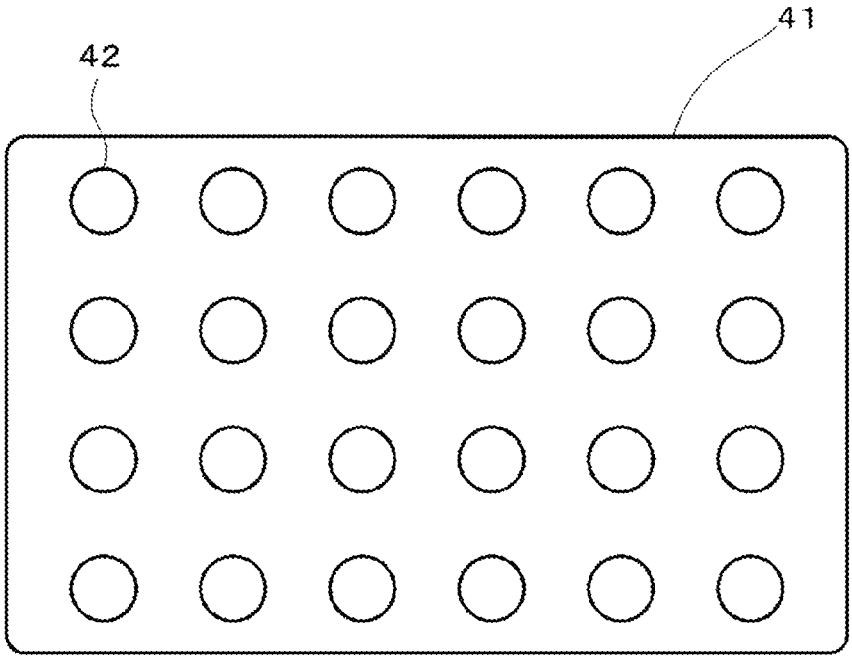
FIG. 3 is a schematic plan view illustrating a jig used in manufacturing the sliding member according to an embodiment.
Figure 4:
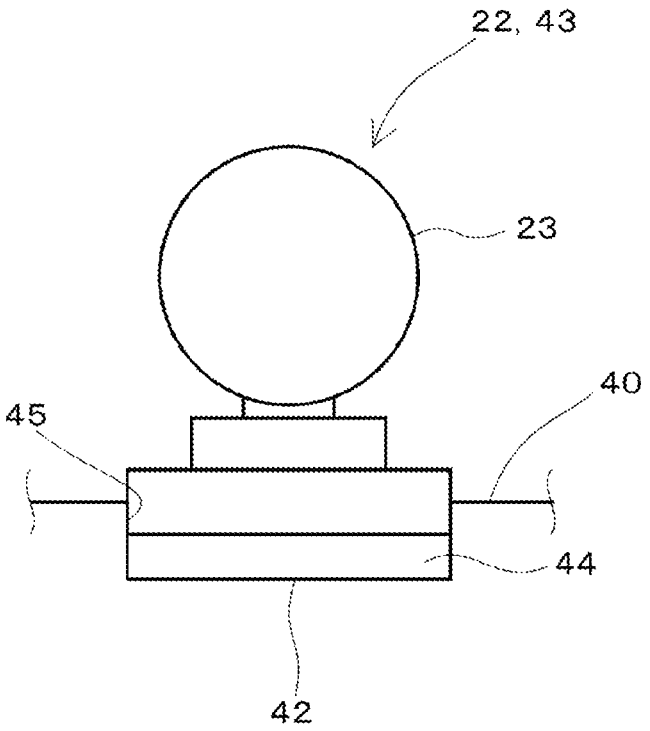
FIG. 4 is a schematic front view for explaining a manufacturing method of the sliding member according to an embodiment.

The material constituting the sliding member 30 is fed into recessed portions 42 of a jig 41 illustrated in FIG. 3 in powder form and molded by sintering. The powder fed into the recessed portions 42 is a powder of an alloy corresponding to the composition of the sliding layer 31 to be formed. When molding is thus performed by sintering, the alloy powder fed into the recessed portions 42 is pressurized by placement of a support member 43, as illustrated in FIG. 4. In the case of this embodiment, as the support member 43, for example, the piston shoe 22 serving as the support layer may be used. With this configuration, a powder 44 fed into the recessed portions 42 is sintered in a state of being pressurized by the weight of the support member 43. In this sintering step, the powder 44 with which the recessed portions 42 are filled is heated from 750° C. to approximately 950° C. together with the jig 41.

Since the powder 44 with which the recessed portions 42 are filled is heated while being pressurized by the weight of the support member 43, the sliding layer 31 formed by sintering hardens on the outer peripheral side compared to at the center in the axial direction. This is because, due to the heating during sintering, the powder 44 with which the recessed portions 42 are filled softens, and the softened powder 44 is pressurized by the weight of the support member 43 in the recessed portions 42, and thus tends to move toward the outer peripheral side. Further movement of the moving softened powder 44 is limited by inner walls 45, which form the recessed portions 42, of the jig 41. Therefore, the sliding layer 31 formed by the sintering of the powder 44 increases in density and also increases in hardness toward the outer peripheral side close to the inner wall 45 and, in contrast, decreases in density and also decreases in hardness toward the center. As a result, in the sliding layer 31 formed by the sintering of the powder 44, a gradient in hardness occurs between the center and the outer peripheral side in the axial direction, with the hardness increasing toward the outer peripheral side. In the sliding layer 31, along with formation of the gradient in hardness in a radial direction by the sintering of the powder 44 pressurized by the support member 43, fine pores are formed in an interior of the sliding layer 31.

Next, evaluation of the performance of the sliding member 30 according to the above-described embodiment will be described.

The performance of the sliding member 30 is evaluated based on friction coefficient, oil retention capacity, and friction coefficient in the state of being impregnated with a lubricating oil.

Samples of Example and Comparative Example

An example of the sliding member 30 of this embodiment was a sliding member formed into a disk shape having a diameter of 28 mm. In the example of the sliding member 30, a Cu-based alloy of Cu-11Sn-0.3P was used. The powder 44 of a material composed of this Cu-based alloy was sintered at from 800° C. to 900° C. to form the sliding member 30. A volume of the obtained sample of the example shrunk by approximately 20% by sintering accompanied by pressurization. Further, the sample of the example of the sliding member 30 had a porosity of approximately 1.5%. For the porosity, a magnified image of any cross section of the sample was visually captured, and the captured image was binarized to identify the pores. Then, an area ratio in the observation field of view of the image was measured, and a ratio of the pores in the observation field of view was calculated as the porosity. In this example, a plurality of observation fields of view were observed in the sample, and the value obtained by averaging the porosities in each observation field of view was defined as the porosity. The porosity was calculated in the same manner for the comparative example described below.

The comparative example compared with this example was prepared. The comparative example was a sample formed into the same disk shape and with the same material as those of the example. The comparative example was obtained by repeatedly sintering and rolling the alloy material to form a uniform plate-shaped member, and then punching the member into a disk shape by a press. This comparative example had a configuration commonly used as a sliding member of the piston shoe 22. The volume of the sample of the comparative example shrunk by about 20% due to the sintering, and the volume also shrunk by 20% or more due to the rolling. Therefore, the comparative example was uniform throughout, and had a structure in which pores are not readily included. As a result, the comparative example had an extremely dense structure with a porosity of 0.012%. That is, compared to the example of this embodiment, the comparative example had a porosity of 1/100 or less.

Figure 5:
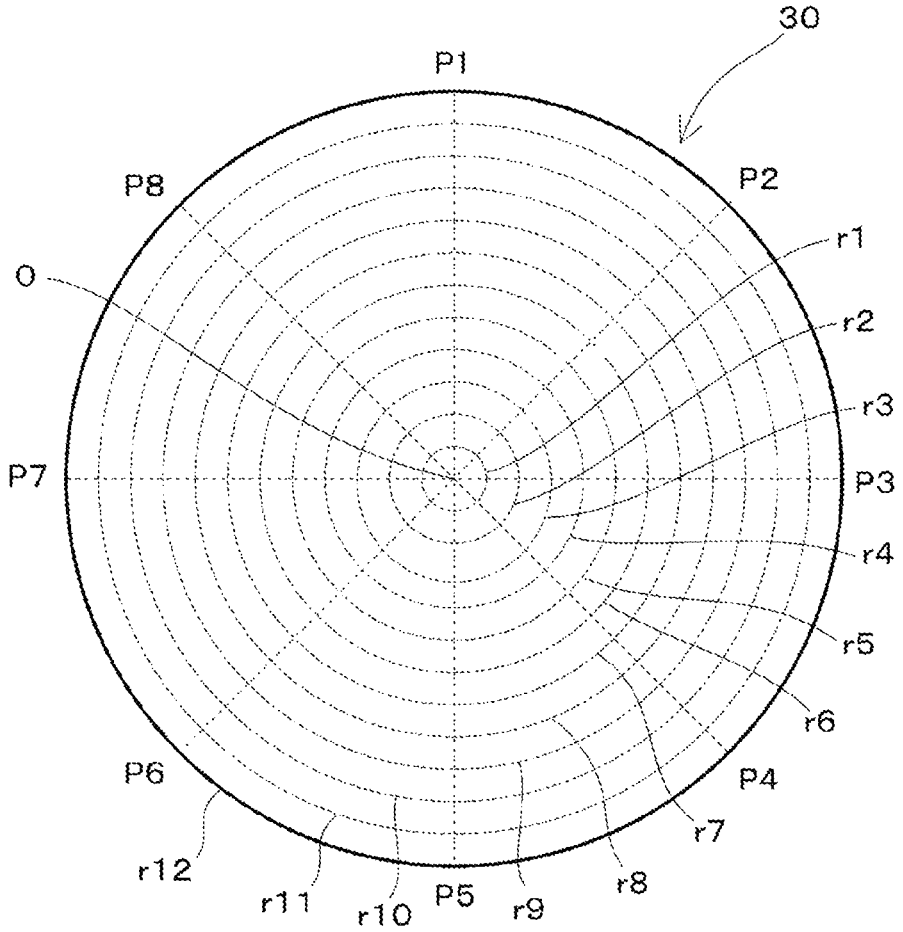
FIG. 5 is a view of the sliding member viewed from the direction of an arrow V in FIG. 2, and is an outline view for explaining measurement positions of the sliding member.
Figure 6:
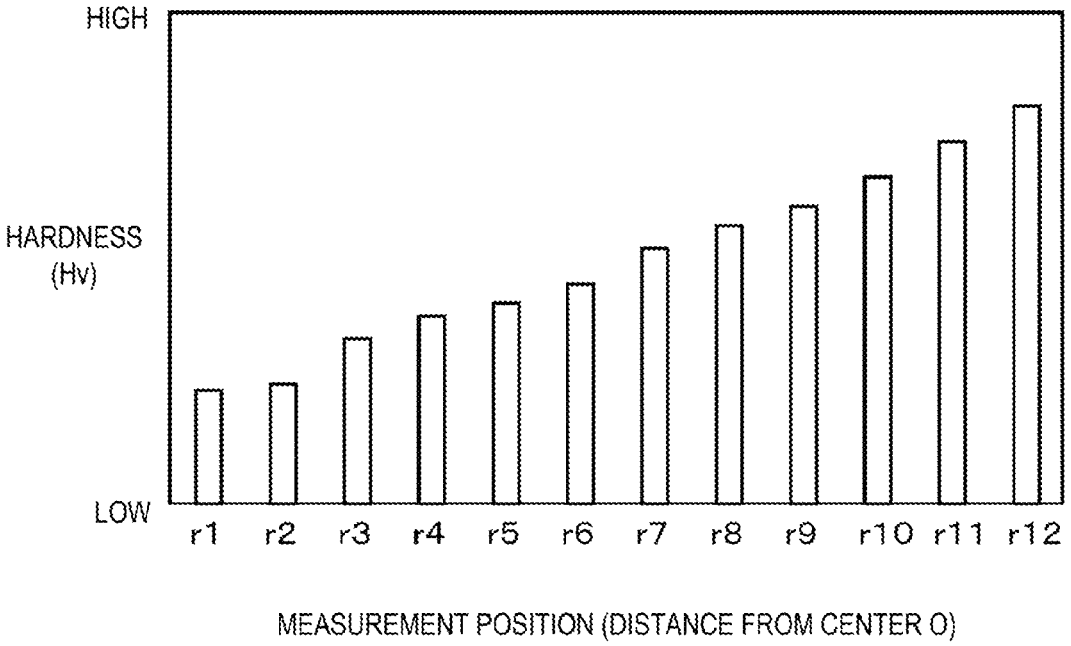
FIG. 6 is a graph schematically showing a relationship between measurement positions and hardness of the sliding member according to an example of an embodiment.

Measurement positions of the samples of the example and the comparative example of the sliding member 30 were set as illustrated in FIG. 5, and hardness (Hv) was measured at each of the measurement positions. Specifically, measurement positions r1 to r12 were set based on a distance from the center O in the radial direction. In the case of this embodiment, the hardness at each measurement position r1 to r12 was determined by measuring, at each measurement position r1 to r12, the hardness at positions P1 to P8 obtained by dividing the sample into eight equal parts in the circumferential direction, and then finding an average thereof. In this embodiment, the measurement positions r1 to r12 were set at equal intervals in the radial direction from the center O. As shown in FIG. 6, in the example, it can be seen that the measured hardness increased from the measurement position r1 close to the center O toward the measurement position r12. Thus, in the example of this embodiment, the hardness was relatively soft at the measurement position r1 close to the center O, and was hard at the measurement position r12 far from the center O.

Figure 7:
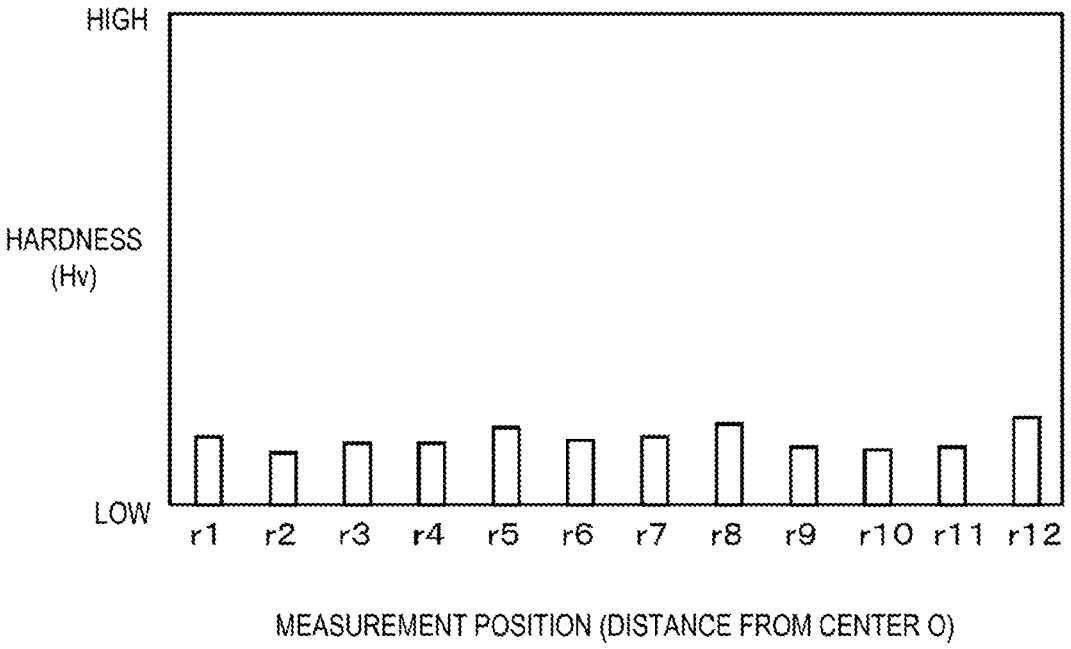
FIG. 7 is a graph schematically showing a relationship between measurement positions and hardness of a sliding member according to a comparative example.

In contrast, in the case of the comparative example, the entire sample was formed into a uniform plate shape. Therefore, in the comparative example, there was substantially no difference in hardness according to the site. Specifically, as shown in FIG. 7, in the comparative example, it can be seen that the measured hardness was substantially the same from the measurement position r1 close to the center O to the measurement position r12. Thus, in the comparative example, the difference in hardness was small from the measurement position r1 close to the center O to the measurement position r12 far from the center O.

Friction Coefficients

As the friction coefficients, both a static friction coefficient μs in a stationary state and a dynamic friction coefficient μk in a sliding state were measured for the example and comparative example of the sliding member 30. These friction coefficients were measured by a reciprocating sliding test based on a Bowden test. As test conditions, a vertical load was set to 1 kg, a reciprocating travel distance and a reciprocating velocity were set to 12 mm and 12 mm/sec, respectively, and the static friction coefficient μs and the dynamic friction coefficient μk were each measured at 1 and 100 reciprocating sliding cycles. In the case of the example shown in FIG. 8, a reciprocating sliding direction was set to the radial direction, that is, between the center O of the sliding member and the outer peripheral side.

As shown in FIG. 8, it can be seen that, in the example, both the static friction coefficient μs and the dynamic friction coefficient μk were lower than those of the comparative example when the number of reciprocating sliding cycles was the same. On the other hand, in the example, the static friction coefficient μs and the dynamic friction coefficient μk differed when the sliding direction was from the center O toward the outer side and when the sliding direction was from the outer side toward the center O. Specifically, in the case of the example, the static friction coefficient μs increased when the direction was from the center O toward the outer side, and decreased when the direction was from the outer side toward the center O. Further, the dynamic friction coefficient μk decreased when the direction was from the center O toward the outer side, and increased when the direction was from the outer side toward the center O.

This is because, in the case of the example, the hardness increased from the center O to the outer peripheral side. That is, this is presumably because, in the example in which the outer peripheral side was hard compared to the center O, wear debris associated with sliding was less likely to occur when the direction was from the center O toward the outer side, and conversely, wear debris associated with sliding was more likely to occur when the direction was from the outer side toward the center O. In contrast, in the comparative example, because the hardness was entirely uniform, no relationship was found between the sliding direction and the friction coefficients.

Figure 10:
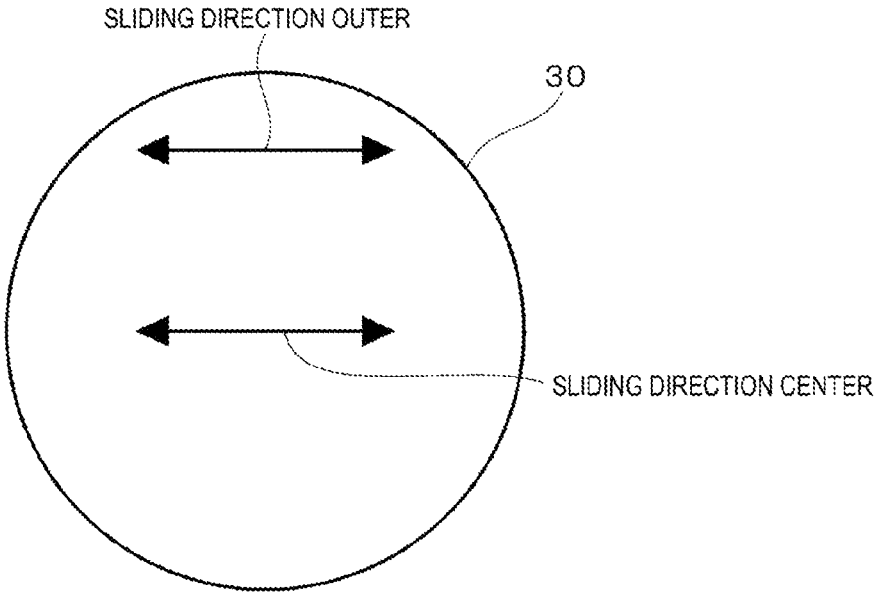
FIG. 10 is an outline view for explaining the sliding direction.

FIG. 9 is an example in which reciprocating sliding directions were set in parallel at a portion close to the center O and at a portion on the outer side. That is, as illustrated in FIG. 10, the sliding directions between the sample and the testing machine were set in parallel at a portion close to the center O and at a portion on the outer side. As shown in FIG. 9, in the example, the friction coefficients tended to be higher at a position close to the center O than on the outer side. This is presumably because, in the case of the example, the position close to the center O had a low hardness compared to that on the outer side, and thus friction was likely to occur. In contrast, in the comparative example, because the hardness was entirely uniform, no relationship was found between the sliding position and the friction coefficients.

Oil Retention Capacity

Capacity of each of the example and the comparative example of the sliding member 30 to retain lubricating oil was confirmed as an oil retention capacity. The oil retention capacity was measured on the basis of a change in mass of the sample. Specifically, the samples of the example and the comparative example were washed and dried, and subsequently a dry mass of each was measured. At this time, when the dry mass did not change continuously twice, the measured mass was set as the dry mass of the sample. The sample for which the dry mass was measured was soaked in lubricating oil for 24 hours and thus impregnated with the lubricating oil. The lubricating oil on a front surface of the sample impregnated with lubricating oil was wiped off, and subsequently the wet mass was measured. Then, by using the sample in the test, a ratio of increased mass was defined as the oil retention capacity. That is, the oil retention capacity was calculated as: Oil retention capacity=(Wet mass−Dry mass)/(Wet mass)×100. Further, two lubricating oils having different viscosities were used. Specifically, as the lubricating oils, VG-22 having a low viscosity and VG-68 having a high viscosity were used. In the comparative example, the oil retention capacity was measured under the same conditions as those of the example described above.

As shown in FIG. 11, compared to the comparative example, the example showed improved oil retention capacity for both lubricating oils having the different viscosities. This is presumably because the example had a high porosity as described above and was thus more likely to contain oil than the comparative example formed with substantially no porosity. Thus, it can be seen that the example that included pores had an improved oil retention capacity compared to that of the comparative example. An "improvement rate" shown in FIG. 11 indicates the percentage of improvement of the oil retention capacity of the example with respect to the comparative example. That is, the improvement rate was calculated as: Improvement rate=Oil retention capacity of example/Oil retention capacity of comparative example×100.

Friction Coefficients in Lubricating Oil Impregnated State

The static friction coefficient μs and the dynamic friction coefficient μk were measured for the example and the comparative example with each in a state of being impregnated with lubricating oil. These friction coefficients were measured by the reciprocating sliding test based on the Bowden test described above, and the measurement conditions were common to those of the example shown in FIG. 8. However, the number of reciprocating sliding cycles was 1 and 1000.

Figure 12:
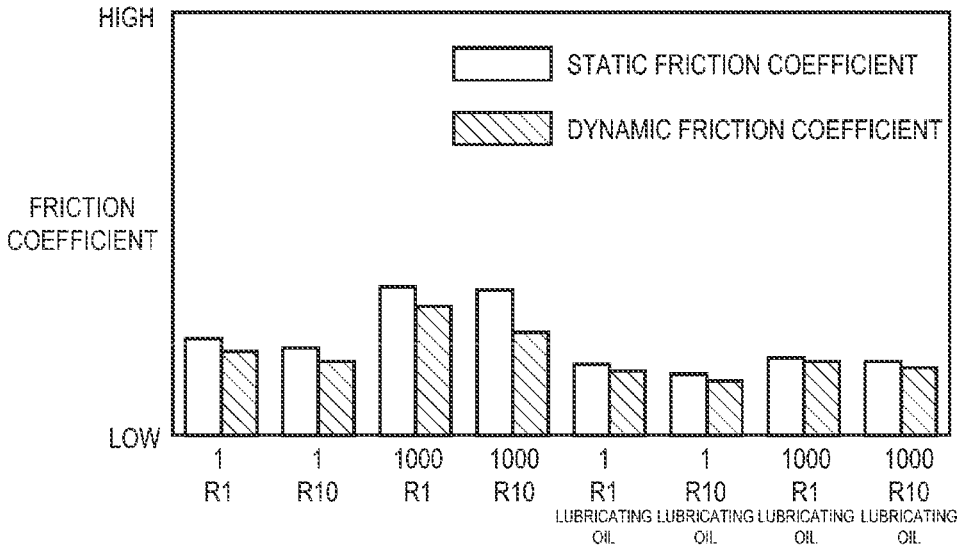
FIG. 12 is a graph schematically showing a relationship between sliding position, number of slides, presence/absence of lubricating oil, static friction coefficient, and dynamic friction coefficient of the example.
Figure 13:
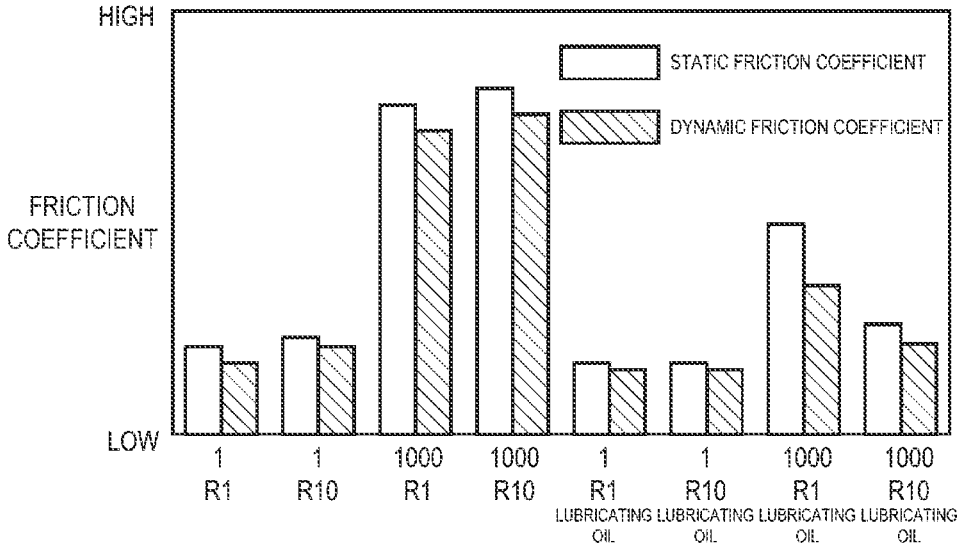
FIG. 13 is a graph schematically showing a relationship between sliding position, number of slides, presence/absence of lubricating oil, static friction coefficient, and dynamic friction coefficient of the comparative example.

As shown in FIG. 12, it can be seen that, with the impregnation of lubricating oil, the friction coefficients of the example were reduced for both 1 and 1000 reciprocating sliding cycles. This is due to a reduction in friction caused by the lubricating oil. In particular, in the example, with the impregnation of the lubricating oil, the friction coefficients were reduced at both the position close to the center O and the position far from the center O even when the number of reciprocating sliding cycles was increased. Thus, it can be seen that the example contributed to reduction in the friction coefficients by retaining the lubricating oil due to the pores. In contrast, as shown in FIG. 13, because the comparative example had uniform hardness throughout and substantially no pores, the lubricating oil retention capacity was low. Therefore, it can be seen that, in the comparative example, even when lubricating oil was used, the friction coefficients increased as the number of reciprocating sliding cycles increased.

As described above, in this embodiment, the sliding layer 31 has a hardness set higher toward the outer side than toward the center O side. Therefore, when sliding on the swash plate 14 of the piston pump 10, the sliding layer 31 has improved wear resistance on the hard outer peripheral side even when subjected to force due to the rotation of the swash plate 14 and the pressurization of the fluid. Further, even when a large force is applied to the sliding layer 31 by the pressurization of the fluid in the fluid chamber 16, the force is received in the soft portion close to the center O of the sliding layer 31 and transmitted to the outer side, and the shape of the sliding layer 31 is maintained by the harder portion on the outer side. As a result, even under severe conditions such as even higher pressure, biased wear is reduced by appropriate hardness according to the site. Accordingly, overall wear resistance can be further improved.

Further, in this embodiment, the sliding layer 31 is porous with pores. When the porosity, which is the ratio of the pores in the sliding layer 31, increases, the amount of the lubricating oil retained in the interior of the sliding layer 31 increases. That is, the lubricating oil is retained in the pores formed in the sliding layer 31. Therefore, by increasing the porosity, friction between the sliding layer 31 and a mating member can be reduced. Accordingly, wear resistance can be further improved.

Further, in the manufacturing method of the sliding member 30 according to this embodiment, the recessed portions 42 of the jig 41 are filled with the powder 44 of the material forming the sliding layer 31, and subsequently the support member 43 is placed thereon and the powder 44 is sintered. Therefore, the powder 44 with which the recessed portions 42 are filled is sintered while being pressurized in the axial direction by the support member 43. As a result, the powder 44 that forms the sliding layer 31 moves when softened by heat due to the sintering by being subject to force from the center O toward the outer periphery, and this movement is restricted by the inner walls 45 of the jig 41. Therefore, the formed sliding layer 31 loses density and becomes relatively soft on the center O side and, conversely, becomes more dense and relatively hard on the outer peripheral side. As a result, the formed sliding layer 31 is formed with a gradient in hardness between the center O and the outer peripheral side. Further, because the sliding layer 31 is formed by the sintering of the powder 44, pores are formed in the interior of the sliding layer 31. Accordingly, pores can be formed in the interior of the sliding member 30 to be formed, and a gradient in hardness can be formed in the radial direction.

The present disclosure described above is not limited to the above-described embodiments, and can be applied to various embodiments without departing from the gist thereof.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A sliding member comprising:

a support layer; and a sliding layer provided on a surface of the support layer, wherein the sliding layer is configured to rotate around an axis and to slide on a mating member, and wherein the sliding layer has a higher hardness at a periphery than at a center at the axis.

2. The sliding member according to claim 1, wherein the sliding layer has a circular shape in a cross section perpendicular to the axis of the sliding layer.

3. The sliding member according to claim 1, wherein the sliding layer is porous with a plurality of pores, and a porosity of the sliding layer is from 0.1% to 3.2%.

4. The sliding member according to claim 2, wherein the sliding layer is porous with a plurality of pores, and a porosity of the sliding layer is from 0.1% to 3.2%.

* * * * *